US008740346B2

(12) United States Patent
Okada

(10) Patent No.: US 8,740,346 B2
(45) Date of Patent: Jun. 3, 2014

(54) LIQUID EJECTING APPARATUS

(75) Inventor: Toshiya Okada, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/332,626

(22) Filed: Dec. 21, 2011

(65) Prior Publication Data

US 2012/0162310 A1 Jun. 28, 2012

(30) Foreign Application Priority Data

Dec. 28, 2010 (JP) ..... 2010-292057

(51) Int. Cl.
*B41J 2/165* (2006.01)

(52) U.S. Cl.
USPC ..... 347/32; 347/29

(58) Field of Classification Search
USPC ..... 347/29, 30, 31, 32, 29.3
See application file for complete search history.

(56) References Cited

U.S. PATENT DOCUMENTS

| | | | | |
|---|---|---|---|---|
| 5,055,856 | A * | 10/1991 | Tomii et al. | 347/30 |
| 5,481,283 | A * | 1/1996 | Watanabe et al. | 347/33 |
| 5,504,508 | A * | 4/1996 | Hashimoto | 347/24 |
| 5,635,965 | A * | 6/1997 | Purwins et al. | 347/31 |
| 5,648,802 | A * | 7/1997 | Abe | 347/29 |
| 5,896,143 | A * | 4/1999 | Matsui et al. | 347/24 |
| 6,007,177 | A * | 12/1999 | Takanaka et al. | 347/28 |
| 6,074,037 | A * | 6/2000 | Nakahara et al. | 347/29 |
| 6,203,136 | B1 * | 3/2001 | Takahashi et al. | 347/32 |
| 6,273,546 | B1 * | 8/2001 | Kobayashi et al. | 347/29 |
| 6,286,930 | B1 * | 9/2001 | Kobayashi et al. | 347/29 |
| 6,390,594 | B1 * | 5/2002 | Tanno et al. | 347/32 |
| 6,471,330 | B1 * | 10/2002 | Umeda et al. | 347/29 |
| 6,491,370 | B2 * | 12/2002 | Momose | 347/30 |
| 6,550,890 | B2 * | 4/2003 | Saijo | 347/29 |
| 6,565,186 | B1 * | 5/2003 | Hattori et al. | 347/24 |
| 6,616,265 | B2 * | 9/2003 | Shindo et al. | 347/29 |
| 7,255,420 | B2 * | 8/2007 | Usuda | 347/29 |
| 7,338,146 | B2 * | 3/2008 | Morikoshi | 347/29 |
| 7,455,385 | B2 * | 11/2008 | Takeda | 347/29 |
| 7,614,721 | B2 * | 11/2009 | Ito et al. | 347/33 |
| 7,686,418 | B2 * | 3/2010 | Ha | 347/29 |
| 7,690,757 | B2 * | 4/2010 | Kusunoki et al. | 347/29 |
| 7,748,821 | B2 * | 7/2010 | Nakashima | 347/33 |
| 7,753,473 | B2 * | 7/2010 | Nakashima | 347/29 |
| 7,794,041 | B2 * | 9/2010 | Akase et al. | 347/19 |
| 7,819,499 | B2 * | 10/2010 | Sakurai | 347/31 |

(Continued)

FOREIGN PATENT DOCUMENTS

| | | | |
|---|---|---|---|
| EP | 1876023 A1 * | 1/2008 | B41J 2/165 |
| JP | 2005-335404 | 12/2005 | |

*Primary Examiner* — Matthew Luu
*Assistant Examiner* — Patrick King
(74) *Attorney, Agent, or Firm* — Workman Nydegger

(57) ABSTRACT

When an ink film between an outer cap and a nozzle face is broken, an ink film formed between an inner cap and the nozzle face is not broken for the following reason. That is, when the ink film between the outer cap and the nozzle face is broken, a negative pressure is not generated on a space formed by the inner cap because the ink film between the inner cap and the nozzle face is formed to be thick and the space communicates with the outside environment by cutouts. Therefore, the ink film formed on the inner cap is not broken at a time when the ink film formed on the outer cap is broken to the inner side with a negative pressure. This makes it possible to suppress splashing droplets from traveling to nozzle rows.

4 Claims, 5 Drawing Sheets

(56) References Cited

U.S. PATENT DOCUMENTS

| | | | | |
|---|---|---|---|---|
| 7,901,033 | B2 * | 3/2011 | Nishida | 347/31 |
| 2002/0130920 | A1 * | 9/2002 | Saijo | 347/31 |
| 2004/0104961 | A1 * | 6/2004 | Hashi et al. | 347/29 |
| 2005/0058265 | A1 * | 3/2005 | Lim | 379/142.01 |
| 2006/0050105 | A1 * | 3/2006 | Sakurai | 347/29 |
| 2007/0279450 | A1 * | 12/2007 | Matsuhashi et al. | 347/29 |
| 2008/0192083 | A1 * | 8/2008 | Nishida | 347/30 |
| 2008/0303858 | A1 * | 12/2008 | Takahashi | 347/29 |
| 2009/0079786 | A1 * | 3/2009 | Watanabe et al. | 347/29 |
| 2009/0135224 | A1 * | 5/2009 | Yakura et al. | 347/29 |
| 2010/0007695 | A1 * | 1/2010 | Miyazawa | 347/30 |
| 2010/0045732 | A1 * | 2/2010 | Fujimori et al. | 347/29 |
| 2011/0050797 | A1 * | 3/2011 | Shindo | 347/30 |
| 2011/0199422 | A1 * | 8/2011 | Shimazaki | 347/29 |

* cited by examiner

LIQUID EJECTING APPARATUS

BACKGROUND

1. Technical Field

The present invention relates to a liquid ejecting apparatus on which a liquid ejecting head which ejects liquid through nozzle openings is mounted.

2. Related Art

With the development of a personal computer, a graphic processing can be executed relatively easily. Therefore, a liquid ejecting apparatus capable of outputting a hard copy of a color image, for example, which is displayed on a display, with high quality has been demanded. In order to meet such demand, there has been provided an ink jet recording apparatus on which an ink jet recording head which ejects ink droplets, for example, as liquid is mounted.

The ink jet recording apparatus gives noises of relatively small at the time of printing, and can form small dots at a high density. Therefore, the ink jet recording apparatus is used in various types of printing including color printing.

Such ink jet recording apparatus includes an ink jet recording head and a paper feeding unit. The ink jet recording head receives ink supply from an ink storage unit. The paper feeding unit moves a recording paper relatively with respect to the ink jet recording head. In the ink jet recording apparatus, ink droplets are discharged onto the recording paper from the ink jet recording head in accordance with a printing signal to form dots so that recording is performed.

Further, nozzle openings through which inks of black, yellow, cyan, and magenta can be discharged are provided on a common head holder (carriage). With this, not only text printing with the black ink but also full color printing can be performed by changing each discharge ratio of the inks.

Such ink jet recording head discharges ink pressurized in a pressure generation chamber as ink droplets onto a recording paper through the nozzle openings so as to perform printing. Therefore, there arises a problem that clogging is caused on the nozzle openings because of increase in ink viscosity due to the evaporation of a solvent from the nozzle openings, solidification of ink, adherence of dusts, mixing of air bubbles, or the like, resulting in printing failure.

In order to solve such problem, the ink jet recording apparatus includes a capping device and a cleaning device in many cases. The capping device seals peripheries of the nozzle openings of the ink jet recording head while printing is not performed. The cleaning device cleans a nozzle plate as needed.

The capping device not only has a function as a cap which prevents ink in the nozzle openings from being dried but also has a so-called cleaning function. To be more specific, the capping device also has the cleaning function of eliminating clogging of the nozzle openings by sealing the peripheries of the nozzle openings on the nozzle plate with a cap member and sucking ink from the nozzle openings with a negative pressure from a suction pump when the clogging occurs on the nozzle openings.

A discharge processing of forcibly discharging ink in order to eliminate clogging of the ink jet recording head is called a cleaning operation. Such cleaning operation is executed when printing is restarted after printing has not been performed for a long time or when a user presses a cleaning switch for eliminating clogging of the ink jet recording head. Further, the cleaning operation is a processing including a wiping operation by a cleaning member formed by an elastic plate such as a rubber after ink droplets have been discharged.

Further, the ink jet recording apparatus also includes a function of applying a driving signal, which does not relate to printing, to the ink jet recording head so as to make the ink jet recording head discharge ink droplets. This function is called a flushing operation. The flushing operation is executed every constant period for recovering an abnormal state of a meniscus in the vicinity of the nozzle openings of the head so as to prevent the clogging of the nozzle openings through which small ink droplets are discharged at the time of the printing from occurring (for example, see JP-A-2005-335404). The abnormal state of the meniscus in the vicinity of the nozzle openings is caused by the wiping operation or the like at the time of the cleaning operation.

In the configuration as described in JP-A-2005-335404, when a cap opening operation is performed, if liquid adheres to an abutment face of a cap member against a nozzle face (face on which the nozzle openings are formed) or the vicinity of the abutment face, a liquid film is formed on a space between the abutment face of the cap member against the nozzle face and the nozzle face when the cap member and the nozzle face are separated from each other. Note that the cap opening operation is an operation of separating the cap member from peripheries of the nozzle openings on a nozzle plate. The liquid film is formed when a capillary force acts on the space due to viscosity of the liquid droplets and the space has such a size that the capillary force acts thereon even if the abutment portion of the cap member against the nozzle face and the nozzle face do not abut against each other.

In a process where the cap member and the nozzle face are further separated from each other, the liquid film formed on the space is elongated. With this, a sealed space formed by the nozzle face and the cap member is enlarged so that a pressure in the sealed space is lowered.

If the pressure in the sealed space is lowered, the liquid film formed on the space is broken while being drawn to the inner side of the sealed space and scatters as splashing droplets. The pressure in the sealed space is a negative pressure immediately before the liquid film is broken. Therefore, almost all the splashing droplets fly toward the inner side of the sealed space. The splashing droplets fly while catching air present around the liquid film. Accordingly, fine air bubbles are contained in the splashing droplets.

As a result, if the splashing droplets reach to the nozzle openings, the fine air bubbles are drawn to a flow path from the nozzles with a negative pressure applied for maintaining shapes of the meniscuses on the nozzle openings. If the air bubbles are present in the liquid flow path, a pressure applied to a pressure generation chamber is reduced by the air bubbles before liquid is ejected. This causes ejection failure so that a problem arises.

SUMMARY

An advantage of some aspects of the invention is to provide a liquid ejecting apparatus which can effectively prevent ejection failure from occurring by making the liquid ejecting apparatus take a configuration in which splashing droplets are made difficult to be generated or a configuration in which a generation source of the splashing droplets and nozzle openings can be shielded from each other even if the splashing droplets scatter such that the splashing droplets do not reach to the nozzle openings.

It is preferable that a liquid ejecting apparatus according to an aspect of the invention include a liquid ejecting head that has a nozzle face on which nozzle openings for ejecting liquid are formed and a cap member that forms a space by abutting against the nozzle face and receives liquid ejected through the nozzle openings in a state where the space is in a negative pressure. In the liquid ejecting apparatus, it is preferable that the cap member include an outer cap portion that abuts against the nozzle face, and an inner cap portion that is provided at the inner side of the outer cap portion, and a cutout be formed at least on the inner cap portion at the side of the nozzle face.

With the liquid ejecting apparatus configured as described above, when liquid is ejected toward the cap member in a state where the cap member abuts against the liquid ejecting head, the liquid ejected through the nozzle openings mainly hits the inner cap portion and is difficult to reach to the outer cap portion.

Further, a liquid film formed between the inner cap portion and the nozzle face is divided into a plurality of films by the cutout formed on the inner cap portion. Therefore, the liquid films are gathered on the divided regions. As a result, the liquid films formed between the inner cap portion and the nozzle face are relatively thicker than a liquid film formed between the outer cap portion and the nozzle face. Accordingly, when the liquid film formed by the outer cap portion becomes splashing droplets and flies into the space formed between the cap member and the nozzle face, the liquid films formed by the inner cap portion are still formed. Therefore, the splashing droplets are absorbed by the liquid films.

Further, the cutout is provided on the inner cap portion. Therefore, the space surrounded by the inner cap portion and the space between the inner cap portion and the outer cap portion communicate with each other. If the outer cap portion is separated from the nozzle face, a negative pressure in the space between the inner cap portion and the outer cap portion is released and the space formed by the inner cap portion communicates with the external environment through the cutout. With this, a negative pressure in the space surrounded by the inner cap portion is also released. Therefore, even if the liquid film between the inner cap portion and the nozzle face is broken, liquid is suppressed from traveling to the space surrounded by the inner cap portion with the negative pressure and liquid is suppressed from adhering to the nozzle face. As described above, the liquid ejected through the nozzle openings can be suppressed from adhering to the outer cap portion. Further, a liquid film can be suppressed from being formed between the cap member and the nozzle face as much as possible. This makes it possible to prevent ejection failure from occurring.

In the ink jet recording apparatus according to another aspect of the invention, it is preferable that a distance between a front end of the inner cap portion and the nozzle face during capping be the same as or longer than a distance between a front end of the outer cap portion and the nozzle face.

With the liquid ejecting apparatus configured as described above, the distance between the front end of the inner cap portion and the nozzle face during the capping is the same as or longer than the distance between the front end of the outer cap portion and the nozzle face. Therefore, when or before the front end of the inner cap portion reaches to the nozzle face, sealing by the outer cap portion is reliably performed in the configuration in which the inner cap portion is additionally provided inside the outer cap portion. Note that the sealing by the outer cap portion can be performed in that the front end of the outer cap portion reliably reaches to and abuts against the nozzle face. This makes it possible to prevent ejection failure from occurring.

Further, in the ink jet recording apparatus according to still another aspect of the invention, it is preferable that an absorbing member be provided in the cap member in a state of being separated from the nozzle face, and a part of the absorbing member also serve as the inner cap portion.

With the liquid ejecting apparatus configured as described above, when the nozzle face hits the inner cap portion or a space having such size that a capillary force acts is generated between the inner cap portion and the nozzle face under a condition that liquid is ejected in a state where the liquid ejecting head is capped with the cap member, the liquid ejected through the nozzles smoothly moves to the inner cap portion formed by the absorbing member with the capillary force. Therefore, the liquid which possibly adheres to the outer cap portion is absorbed by the inner cap portion. Accordingly, adherence of the liquid to the outer cap portion does not physically occur. This makes it possible to suppress splashing droplets from being generated when the outer cap portion and the nozzle face are separated from each other and prevent ejection failure from occurring.

Further, it is preferable that an ink jet recording apparatus according to still another aspect of the invention include a liquid ejecting head that has a nozzle face on which nozzle openings for ejecting liquid are formed, and a cap member that forms a space by abutting against the nozzle face and receive liquid ejected through the nozzle openings in a state where the space is in a negative pressure. In the ink jet recording apparatus, it is preferable that the cap member include an outer cap portion that abuts against the nozzle face, and an inner cap portion that is provided at the inner side of the outer cap portion, a cutout be formed at least on the inner cap portion at the side of the nozzle face, and a distance between the inner cap portion and the nozzle face be set to be a distance at which a liquid film formed between the inner cap portion and the nozzle face is not broken when a liquid film formed between the outer cap portion and the nozzle face is broken.

With the liquid ejecting apparatus configured as described above, even if a liquid film is broken due to reduction in pressure from the outer cap portion, the liquid film formed on the inner cap portion is kept without being influenced by the reduction in pressure. Therefore, splashing droplets generated from the outer cap portion is absorbed by the liquid film left on the inner cap portion and does not reach to the nozzle openings. This makes it possible to prevent ejection failure from occurring.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment and variations are described in the following order in order to clarify contents of the invention.

A. Apparatus Configuration according to the Embodiment
B. Capping Unit according to the Embodiment
C. Variations
C-1. First Variation
C-2. Second Variation

A. Apparatus Configuration According to the Embodiment

Figure 1:
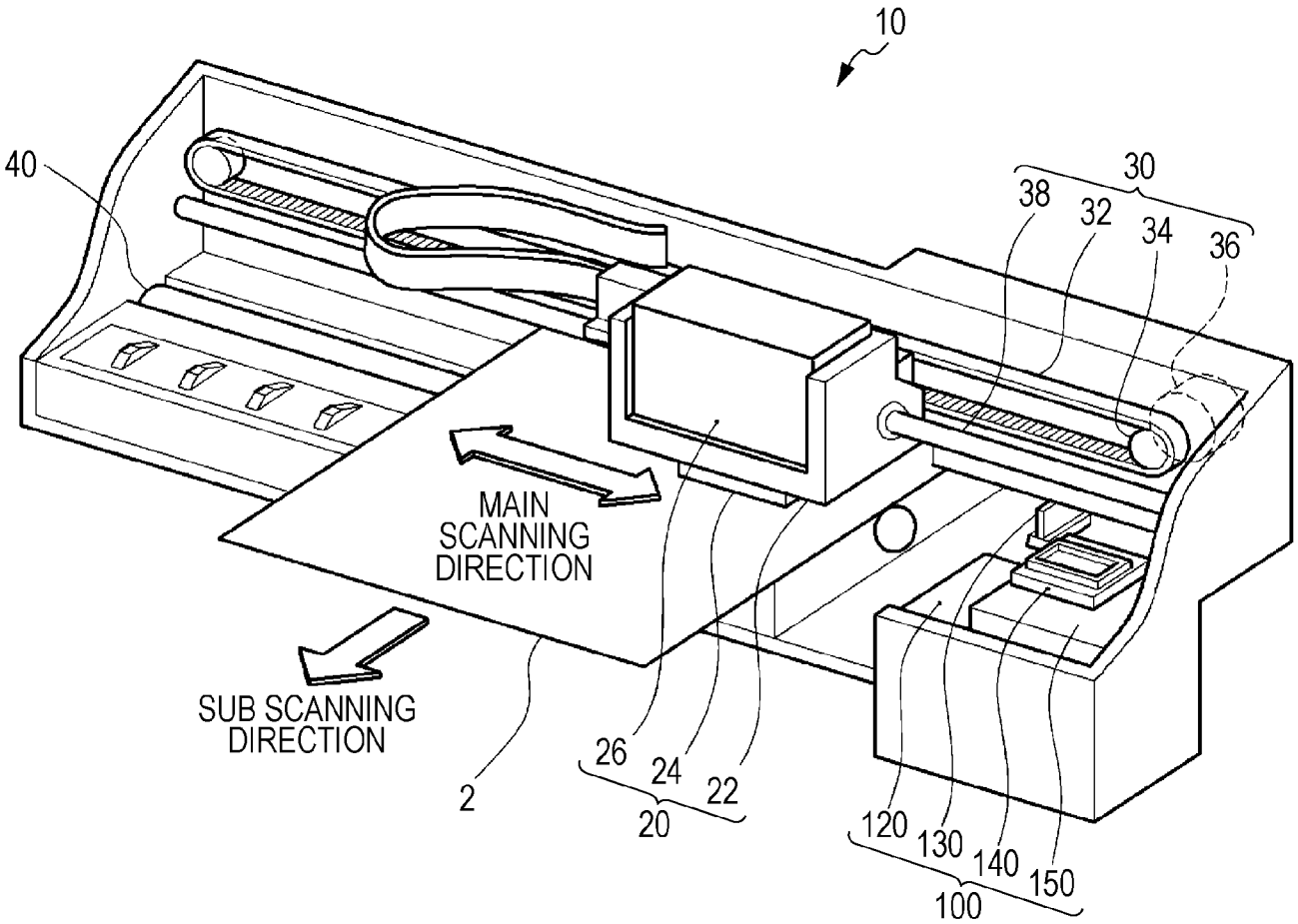
FIG. 1 is a schematic perspective view illustrating an ink jet printer according to an embodiment.

FIG. 1 is a schematic perspective view illustrating an ink jet printer 10 as a liquid ejecting apparatus according to the embodiment. As illustrated in FIG. 1, the ink jet printer 10 is constituted by a carriage 20, a driving mechanism 30, a platen roller 40, a maintenance mechanism 100, and the like. The carriage 20 forms ink dots on a print medium 2 while reciprocating in a main scanning direction. The driving mechanism 30 makes the carriage 20 reciprocate. The platen roller 40 feeds the print medium 2. The maintenance mechanism 100 performs maintenance such that the ink jet printer 10 can normally print.

An ink cartridge 26, a carriage case 22, a discharge head 24, and the like are provided on the carriage 20. The ink cartridge 26 accommodates ink. The ink cartridge 26 is mounted on the ink carriage case 22. The discharge head 24 is one type of a liquid ejecting head. The discharge head 24 is mounted on the carriage case 22 at a bottom side (at a side facing to the print medium 2) and discharges ink. Ink in the ink cartridge 26 is introduced to the discharge head 24 and an accurate amount of ink is discharged onto the print medium 2 as a discharge medium from the discharge head 24 through nozzle openings (not illustrated in FIG. 1). With this, an image is printed. The nozzle openings are illustrated in FIG. 3 to FIG. 6 and are described in detail with reference thereto.

The driving mechanism 30 which makes the carriage 20 reciprocate is constituted by a guide rail 38, a timing belt 32, a driving pulley 34, a step motor 36, and the like. The guide rail 38 is provided so as to extend in the main scanning direction. A plurality of teeth are formed on an inner side of the timing belt 32. The driving pulley 34 is engaged with the teeth of the timing belt 32. The step motor 36 drives the driving pulley 34. A portion of the timing belt 32 is fixed to the carriage case 22. If the timing belt 32 is driven, the carriage case 22 can be moved along the guide rail 38. Further, the timing belt 32 and the driving pulley 34 are engaged with each other with the teeth. Therefore, if the driving pulley 34 is driven by the step motor 36, the carriage case 22 can be moved with high accuracy in accordance with a driving amount of the driving pulley 34.

The platen roller 40 which feeds the print medium 2 is driven by a driving motor and a gear mechanism (which are not illustrated) so as to feed the print medium 2 in a sub scanning direction by a predetermined amount at time. The ink jet printer 10 drives the discharge head 24 in the main scanning direction and discharges inks of each color through the nozzle openings while feeding the print medium 2 in the sub scanning direction by the above mechanisms. With this, the ink jet printer 10 prints an image on the print medium 2.

Thus, in the ink jet printer 10, ink of each color is discharged through a plurality of nozzle openings provided on the discharge head 24 so that an image is printed. It is needless to say that it is important to maintain nature of ink in the nozzle openings to be in an appropriate state in order to discharge the ink through the nozzle openings appropriately. If the nature of the ink is changed (for example, viscosity of the ink is increased) due to evaporation of a volatile component in the ink, the ink cannot be discharged through the nozzle openings normally. For this reason, the ink jet printer 10 includes the maintenance mechanism 100 for maintaining a state where ink can be discharged normally in addition to various mechanisms for printing an image.

Figure 2:
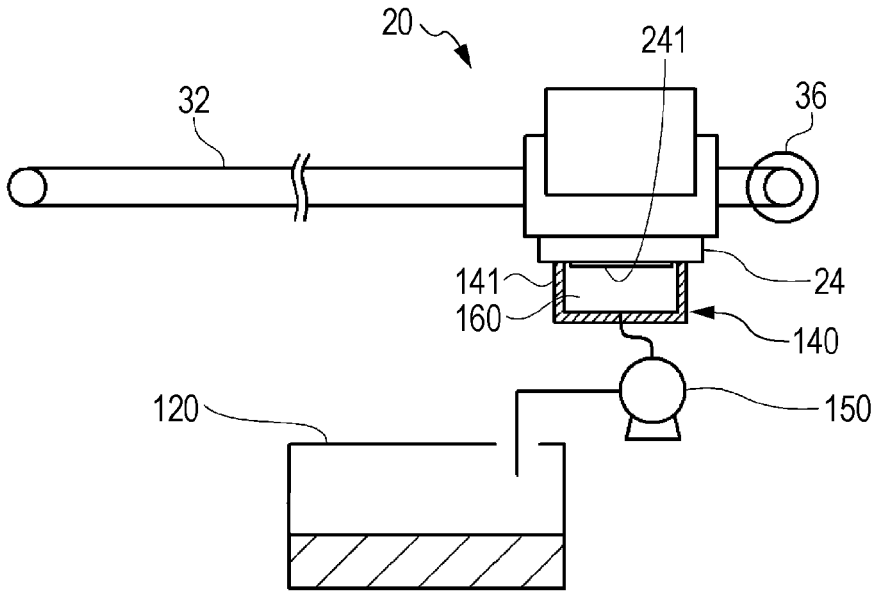
FIG. 2 is a schematic descriptive view illustrating a maintenance mechanism of the ink jet printer.

FIG. 2 is a schematic descriptive view illustrating the maintenance mechanism 100.

As illustrated in FIG. 1 and FIG. 2, the maintenance mechanism 100 is provided on a region called a home position located at the outside of a print region. The maintenance mechanism 100 is constituted by a wiper blade 130, a capping unit 140, a suction pump 150, and the like. The wiper blade 130 sweeps the surface of the discharge head 24. The capping unit 140 is one type of a cap member. The capping unit 140 is provided on the discharge head 24 at a bottom side and is pressed against a nozzle face 241 on which nozzle openings are formed so as to form a space 160 between the capping unit 140 and the discharge head 24. The suction pump 150 is connected to the space 160 formed by the capping unit 140 and the nozzle face 241. Further, a waste liquid tank 120 is provided at the lower side of the suction pump 15. When printing is not performed, the carriage 20 is moved to the home position and the space 160 is formed on the bottom of the discharge head 24 by pressing the capping unit 140 against the discharge head 24. A plurality of fine nozzle openings (not illustrated) through which ink is discharged are formed on the bottom of the discharge head 24. If the space 160 is formed in the above manner, ink in the discharge head 24 can be prevented from being dried and being increased in viscosity.

Further, even if the capping unit 140 is pressed against the discharge head 24 so as to prevent ink from being dried, water and a volatile component in ink are reduced little by little over long time so that nature of the ink is changed (for example, viscosity of the ink is increased). In this case, an operation (cleaning operation) in which an inner portion of the space 160 is made in a negative pressure by operating the suction pump 150 in a state where the capping unit 140 is mounted so as to suck the ink through the nozzle openings is performed. If the cleaning operation is performed, ink of which nature has been changed can be forcibly discharged through the nozzle openings. This makes it possible to recover the nozzle openings to be in a normal state.

As described above, in the ink jet printer 10, ink can be prevented from being evaporated or ink of which nature has been changed can be forcibly discharged by the maintenance mechanism 100. Accordingly, the discharge head 24 can be kept to be in a normal state.

However, as described above, when the cap opening operation is performed, if ink adheres to an upper end of an inner wall face of an outer cap 141 of the capping unit 140, that is, to the outer cap 141 at a position near the nozzle face 241, a capillary force is generated and an ink film as a liquid film is formed between the outer cap 141 and the nozzle face 241 immediately after the outer cap 141 and the nozzle face 241 are separated from each other. Then, if the outer cap 141 and the nozzle face 241 are further separated from each other, ink scatters as splashing droplets. If the splashing droplets reach to the nozzle openings, there is a risk that discharge failure is caused, resulting in a problem. In order to eliminate such risk, in the ink jet printer 10 according to the embodiment, the capping unit 140 has the following configuration for suppressing ink from adhering to the outer cap 141 or suppressing splashing droplets from reaching to the nozzle openings so as to prevent discharge failure from occurring.

B. Capping Unit According to the Embodiment

Figure 3:
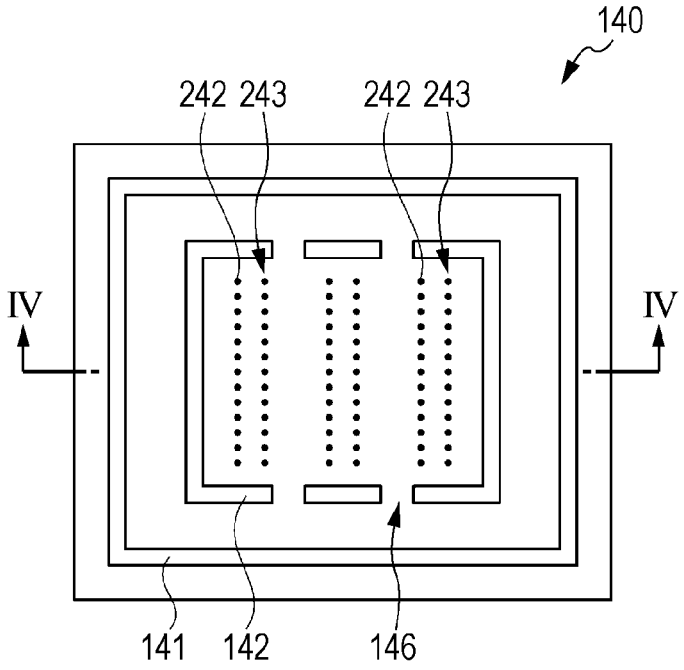
FIG. 3 is a plan view for explaining a capping unit.
Figure 4:
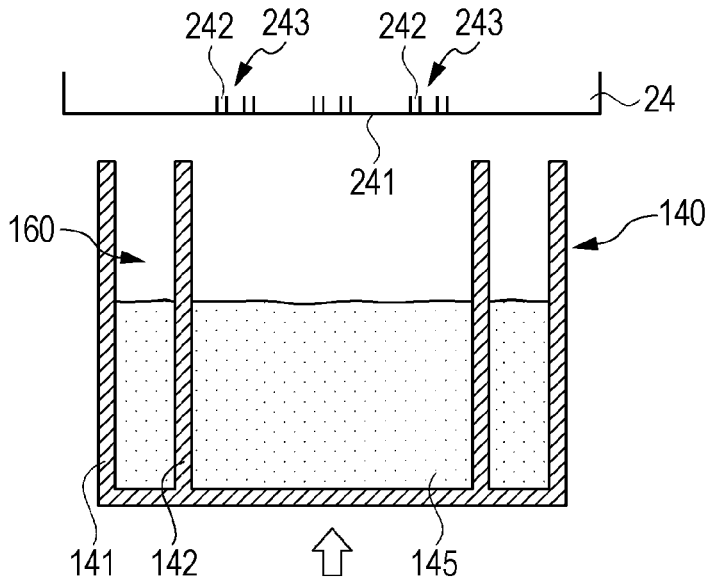
FIG. 4 is a cross-sectional view cut along a line IV-IV in FIG. 3.

FIG. 3 and FIG. 4 are descriptive views illustrating the capping unit 140 according to the embodiment. FIG. 3 corresponds to a plan view when seen from the side of the discharge head 24. FIG. 4 corresponds to a cross-sectional view cut along a line IV-IV in FIG. 3. In FIG. 3 and FIG. 4, the discharge head 24 is also illustrated together with the capping unit 140.

As illustrated in FIG. 3 and FIG. 4, the capping unit 140 according to the embodiment includes an outer cap 141, an inner cap 142, and an absorbing member 145.

Further, in FIG. 3 and FIG. 4, six nozzle rows 243 formed with nozzle openings 242 are formed on the nozzle face 241. The number of the nozzle rows 243 is not limited to six and may be arbitrarily set. If an entire outer circumference of the outer cap 141 abuts against the nozzle face 241 of the discharge head 24, the outer cap 141 can form the space 160 in the capping unit 140. Although the space 160 is desirably a sealed space, it is sufficient that the space 160 has a sealing property to the extent that an inner portion of the space 160 is in a negative pressure by the cap opening operation and the cleaning operation.

The inner cap 142 is formed at the inner side of the outer cap 141 at a position between an inner wall of the outer cap 141 and the nozzle rows 243. Cutouts 146 are provided at least a part of the inner cap 142 at the side of the nozzle face 241 unlike the configuration of the outer cap 141. Therefore, a part of the inner cap 142 does not abut against the nozzle face 241. Accordingly, when liquid adheres to an interface between the inner cap 142 and the nozzle face 241, an ink film is divided into a plurality of films by the cutouts 146. The divided liquid films attract ink with the capillary forces thereof so as to be relatively thicker than the ink film formed on an interface between the outer cap 141 and the nozzle face 241.

Figure 5:
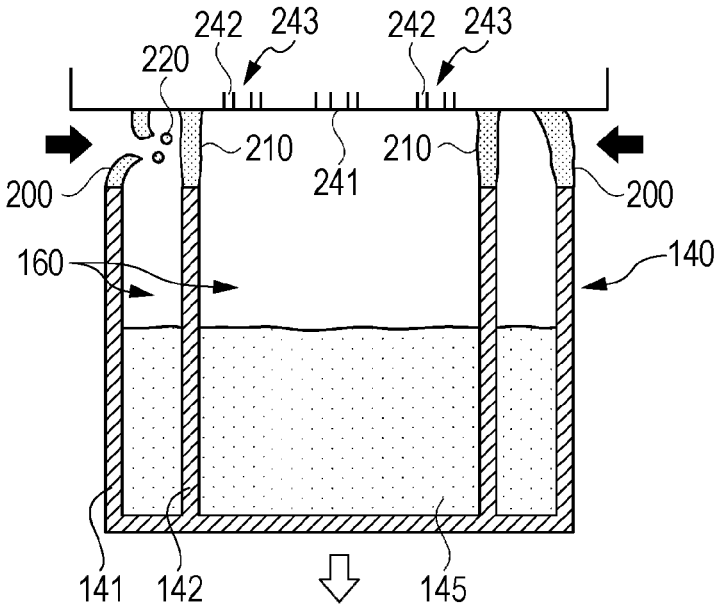
FIG. 5 is a schematic cross-sectional view illustrating the capping unit during a cap opening operation.

FIG. 5 is a schematic cross-sectional view illustrating the capping unit 140 during the cap opening operation. In the cap opening operation, the capping unit 140 is moved in the direction of being separated from the discharge head 24, that is, in the direction as indicated by an outline arrow in FIG. 5.

An ink film 210 formed on the inner cap 142 is not broken at the time when an ink film 200 formed on the outer cap 141 is broken to the inner side with the negative pressure. Therefore, splashing droplets 220 can be suppressed from traveling to the nozzle rows 243. This will be described in detail below.

The ink film 200 formed on the interface between the nozzle face 241 and the outer cap 141 is broken mainly due to the negative pressure generated on the thin ink film 200 and the space 160. Directions of the force applied to the ink film 200 with the negative pressure are indicated by black arrows in FIG. 5.

In the embodiment, when the cap opening operation is performed, the ink film 210 formed between the inner cap 142 and the nozzle face 241 is not broken when the ink film 200 formed between the outer cap 141 and the nozzle face 241 is broken for the following reason. That is, when the ink film 200 formed between the outer cap 141 and the nozzle face 241 is broken, a negative pressure is not generated on the space 160 formed by the inner cap 142 because the ink film 210 formed between the inner cap 142 and the nozzle face 241 is formed to be thick and the space 160 communicates with the outside environment by the cutouts 146 as described above. Accordingly, the ink film 210 formed on the inner cap 142 is not broken at the time where the ink film 200 formed on the outer cap 141 is broken to the inner side with the negative pressure. This makes it possible to suppress the splashing droplets 220 from traveling to the nozzle openings 242 and the nozzle rows 243.

A distance between the inner cap 142 and the nozzle face 241 is required to be set such that the ink film 210 is not broken when the ink film 200 formed due to a distance between the outer cap 141 and the nozzle face 241 is broken. That is, the distance between the inner cap 142 and the nozzle face 241 may be the same as or slightly longer than the distance between the outer cap 141 and the nozzle face 241. The distance between the inner cap 142 and the nozzle face 241 can be set to be slightly longer than the distance between the outer cap 141 and the nozzle face 241 by making the adjustment of setting the widths of the cutouts 146 to be larger, increasing the number of cutouts 146, or the like in consideration of the viscosity of ink since the ink film 210 divided by the cutouts 146 is required to be thick.

Figure 6:
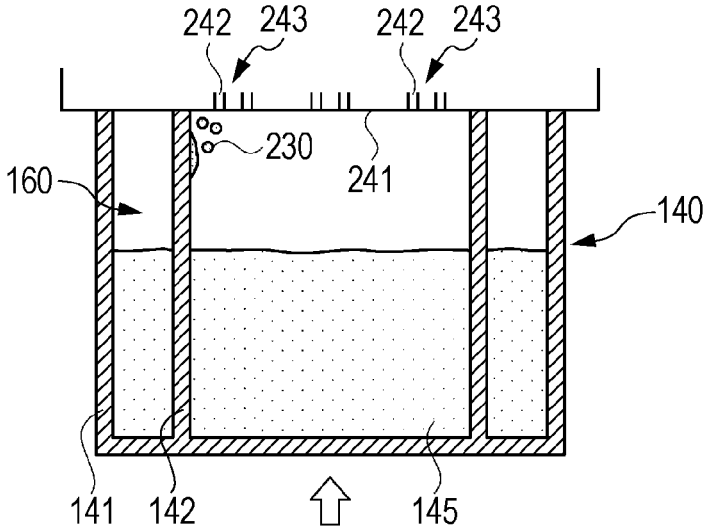
FIG. 6 is a schematic cross-sectional view illustrating the capping unit when ink is discharged through nozzle openings during capping.

FIG. 6 is a schematic cross-sectional view illustrating the capping unit 140 when ink 230 is discharged through the nozzle openings 242 during capping by the cleaning operation and the flushing operation. Under the condition that the ink 230 is discharged in a state where the discharge head 24 is capped, the ink 230 discharged through the nozzle openings 242 mainly hits the inner cap 142. Therefore, the ink 230 can be suppressed from adhering to the outer cap 141. With this, the splashing droplets 220 as illustrated in FIG. 5 can be suppressed from being generated when the outer cap 141 and the nozzle face 241 are separated from each other.

C. Variations

Several variations of the above embodiment can be considered. Hereinafter, these variations are simply described. It will be understood that the variation has the same configuration unless a difference in the configuration between the above embodiment and the variation is otherwise particularly defined.

C-1. First Variation

Figure 7:
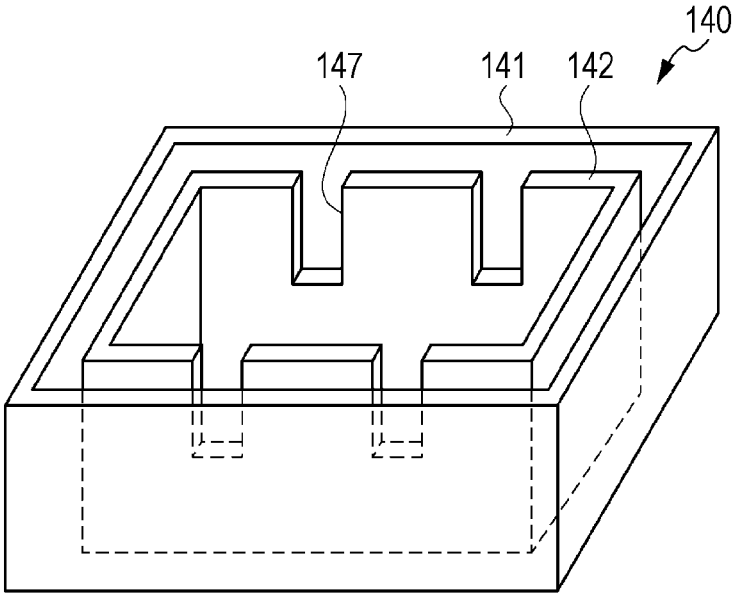
FIG. 7 is a schematic perspective view illustrating a capping unit according to a first variation.

FIG. 7 is a schematic perspective view illustrating the capping unit 140 according to the variation. As a configuration of the inner cap 142 used for the capping unit 140 according to the variation, the inner cap 142 is not required to be completely divided by cutouts. A configuration in which cutouts 147 as illustrated in FIG. 7 are formed on the inner cap 142 at the side of the nozzle face and the inner cap 142 is integrally formed may be employed. With this, a configuration of the apparatus can be made simpler.

C-2. Second Variation

In the above embodiment, the inner cap is formed with a material which is the same as that of the outer cap. However, a portion of an absorbing member may be made higher so as to have a function of the inner cap.

Figure 8:
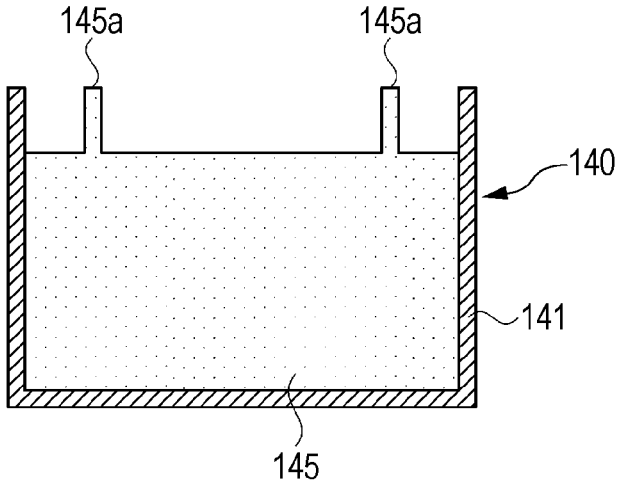
FIG. 8 is a schematic cross-sectional view illustrating a capping unit according to a second variation.

FIG. 8 is a schematic cross-sectional view illustrating the capping unit 140 according to the variation. In the variation, a portion of the absorbing member may be made higher so as to have the function of the inner cap. Portions 145*a* of the absorbing member can have the function of the inner cap with a shape as illustrated in FIG. 8. Further, with this configuration, after ink discharged through the nozzle openings 242 adheres to the portions 145*a* of the absorbing member during the capping, the ink is rapidly absorbed by the absorbing member 145. Therefore, ink can be suppressed from adhering to the outer cap 141 and splashing droplets can be suppressed from being generated when the outer cap 141 and the nozzle face 241 are separated from each other.

A distance between the portions 145*a* of the absorbing member and the nozzle face 241 as illustrated in FIG. 5 and FIG. 6 is required to be set such that the portions 145*a* of the absorbing member and the nozzle face 241 make contact with each other when the ink film 200 formed by the distance between the outer cap 141 and the nozzle face 241 is broken. The distance between the portions 145*a* of the absorbing member and the nozzle face 241 is required to be set as described above because the portions 145*a* of the absorbing member absorb ink and the ink film 210 is not formed. Accordingly, it is preferable that the distance between the portions 145*a* of the absorbing member and the nozzle face 241 be slightly shorter than the distance between the outer cap 141 and the nozzle face 241. To be more specific, the distance between the portions 145*a* of the absorbing member and the nozzle face 241 is set to be a distance which is shorter than the distance at which the ink film 200 formed between the outer cap 141 and the nozzle face 241 is broken. When the ink film 200 is broken, the portions 145*a* of the absorbing member are required to make contact with the nozzle face 241.

Hereinbefore, the liquid ejecting apparatus has been described. However, the invention is not limited to all of the above embodiment and variations. The invention can be realized in various modes within the range without departing from the scope of the invention. For example, the liquid ejecting apparatus may be a printing apparatus (so-called line head printer or the like) including a larger ejecting head.

The entire disclosure of Japanese Patent Application No. 2010-292057, filed Dec. 28, 2010 is expressly incorporated by reference herein.

What is claimed is:

1. A liquid ejecting apparatus comprising:

a liquid ejecting head that has a nozzle face on which nozzle openings for ejecting liquid are formed; and a cap member that forms a space by abutting against the nozzle face and receives liquid ejected through the nozzle openings in a state where the space is in a negative pressure, the cap member having an outer cap portion that abuts against the nozzle face, and an inner cap portion that abuts against the nozzle face and that is provided at an inner side of the outer cap portion, wherein a first space is formed between the outer cap portion and the inner cap portion, and a second space is formed in which the inner cap portion at least partially surrounds the nozzle openings, the inner cap portion having a cutout which does not abut against the nozzle face, the cutout connecting the first space with the second space, wherein an ink film formed between the inner cap portion and the nozzle face is not broken at a time that a second ink film formed between the outer cap portion and the nozzle face is broken, in a cap opening operation when the cap member is moved in a direction of being separated from the nozzle face.

2. The liquid ejecting apparatus according to claim 1, wherein a distance between a front end of the inner cap portion and the nozzle face is the same as or longer than a distance between a front end of the outer cap portion and the nozzle face.

3. The liquid ejecting apparatus according to claim 1, wherein an absorbing member is provided in the cap member in a state of being separated from the nozzle face, and a part of the absorbing member also serves as the inner cap portion.

4. A liquid ejecting apparatus comprising:

a liquid ejecting head that has a nozzle face on which nozzle openings for ejecting liquid are formed; and a cap member that forms a space by abutting against the nozzle face and receives liquid ejected through the nozzle openings in a state where the space is in a negative pressure, the cap member having an outer cap portion that abuts against the nozzle face, and an inner cap portion that abuts against the nozzle face and that is provided at an inner side of the outer cap portion, wherein a first space is formed between the outer cap portion and the inner cap portion and a second space is formed in which the inner cap portion at least partially surrounds the nozzle openings, the inner cap portion having a cutout which does not abut against the nozzle face, the cutout connecting the first space with the second space, and a distance between the inner cap portion and the nozzle face is set to be such distance that a liquid film formed between the inner cap portion and the nozzle face is not broken when a liquid film formed between the outer cap portion and the nozzle face is broken, in a cap opening operation when the cap member is moved in a direction of being separated from the nozzle face.

* * * * *